US009406433B2

(12) United States Patent
Lau et al.

(10) Patent No.: US 9,406,433 B2
(45) Date of Patent: Aug. 2, 2016

(54) SOUND MITIGATION FOR AIR CORE REACTORS

(71) Applicant: TRENCH LIMITED, Scarborough (CA)

(72) Inventors: Tom Chiu Hung Lau, Toronto (CA); Fabian Best, Ajax (CA); Terry Wai Cheong Wong, Scarborough (CA); Willie Kim Fung Chan, Scarborough (CA); Sean Alves, Ajax (CA); Thong Tong, Toronto (CA); Michael Sharp, Pickering (CA)

(73) Assignee: TRENCH LIMITED, Scarborough, Ontario (CA)

( * ) Notice: Subject to any disclaimer, the term of this patent is extended or adjusted under 35 U.S.C. 154(b) by 0 days.

(21) Appl. No.: 14/409,306

(22) PCT Filed: Jul. 9, 2013

(86) PCT No.: PCT/CA2013/050529

§ 371 (c)(1),
(2) Date: Dec. 18, 2014

(87) PCT Pub. No.: WO2014/008596

PCT Pub. Date: Jan. 16, 2014

(65) Prior Publication Data

US 2015/0170826 A1 Jun. 18, 2015

Related U.S. Application Data

(60) Provisional application No. 61/669,317, filed on Jul. 9, 2012.

(51) Int. Cl.
*H01F 27/06* (2006.01)
*H01F 27/08* (2006.01)

(Continued)

(52) U.S. Cl.
CPC ..... *H01F 27/2823* (2013.01); *H01F 27/33* (2013.01); *H01F 27/38* (2013.01)

(58) Field of Classification Search
CPC . H01F 27/322; H01F 27/027; H01F 27/2823; H01F 27/323; H01F 5/04; H01F 17/02
USPC ..... 336/60, 65, 180, 186, 192, 207
See application file for complete search history.

(56) References Cited

U.S. PATENT DOCUMENTS 2,663,828 A * 12/1953 Sauer ..... H01F 37/005 336/155
2,959,754 A * 11/1960 MacKinnon ..... H01F 37/005 336/185

(Continued)

FOREIGN PATENT DOCUMENTS

JP 59172709 A1 * 9/1984

*Primary Examiner* — Tsz Chan

(57) ABSTRACT

An air core reactor (47) including a plurality of concentric conductor winding packages (44, 46) wherein a force ($F^+$) generated by the interaction of current (+) flowing through one package and a magnetic field (42) generated by the reactor is out of phase ($F^-$) with a force generated in another package, thereby effectively mitigating audible sound generated by power operation of the reactor. In one embodiment (FIG. 3), the out of phase force may be generated when at least one winding (38*c*, 37*d*) of one package (38) is configured to conduct a current (−) that is at least 10 degrees out of phase with a current (+) conducted by another package (40) or other windings (38*a*, 38*b*) of the reactor (36).

18 Claims, 3 Drawing Sheets

(51) Int. Cl.

| | |
|---|---|
| ***H01F 27/28*** | (2006.01) |
| ***H01F 27/29*** | (2006.01) |
| ***H01F 27/30*** | (2006.01) |
| ***H01F 27/33*** | (2006.01) |
| ***H01F 27/38*** | (2006.01) |

(56) References Cited

U.S. PATENT DOCUMENTS 3,144,628 A * 8/1964 Rabins ..... H01F 27/28 323/346
3,264,590 A * 8/1966 Trench ..... H01F 37/005 336/147
3,309,639 A 3/1967 Goolsby, Jr.
3,443,255 A * 5/1969 Massar ..... H01F 6/02 323/360
3,538,473 A * 11/1970 Leibinger ..... H01F 27/2871 336/187
4,219,791 A * 8/1980 Moore ..... H01F 27/323 174/120 SR
4,462,017 A * 7/1984 Knapp ..... H01F 37/005 336/196
5,027,099 A * 6/1991 Burke ..... H01F 37/005 336/180
2004/0066263 A1* 4/2004 Zhang ..... H04R 9/063 336/178
2006/0103976 A1* 5/2006 Quinn ..... H02K 15/00 360/119.07
2012/0105190 A1 5/2012 Mitani et al.

* cited by examiner

SOUND MITIGATION FOR AIR CORE REACTORS

CROSS REFERENCE TO RELATED APPLICATIONS

This application is the US National Stage of International Application No. PCT/CA2013/050529 filed Jul. 9, 2013 and claims benefit thereof, the entire content of which is hereby incorporated herein by reference. This application claims benefit of the 9 Jul. 2012 filing date of U.S. provisional patent application No. 61/669,317.

FIELD OF THE INVENTION

The present invention relates to dry type air core reactors of the type used in utility and power applications and, more particularly, to mitigating audible sound produced by such reactors.

BACKGROUND OF THE INVENTION

Air core reactors are inductive devices used in high voltage power transmission, distribution and industrial applications. Air core reactors are used for a variety of purposes, including for filtering out harmonics, as shunt devices which compensate for introduction of capacitive reactive power, and as devices which limit short circuit currents. Air core reactors are formed with a series of concentrically positioned, spaced-apart winding layers, referred to as packages, in a cylindrical configuration. The packages are positioned between upper and lower current carrying members, sometimes referred to as spider units or spiders. The spider units include a plurality of arms radiating along a plane and away from a central hub position in a star configuration. Among other functions, the spider units may serve as terminals for connecting power lines and for interconnecting the winding layers in an electrically parallel configuration. The reactors are normally installed with the spider units in a horizontal orientation with respect to an underlying horizontal ground plane so that the major axis of the cylindrical configuration extends vertically upward from the ground plane. For a single reactor, or for the lower-most reactor in a stacked configuration of two or more reactors, the winding layers are supported above the ground by the lower spider unit and a series of insulators and structural leg members which extend from the lower spider unit to the ground.

Because air core reactors carry alternating current through coiled electrical conductors, they are subjected to mechanical forces created by the interaction of the electrical current and the magnetic field generated by the reactor. FIG. 1 illustrates the general direction of net forces exerted on a typical air core reactor 1 during power operation. Due to the design of the device, the frequency of the force is twice the frequency of the current, and the magnitude of the force is proportional to the square of the current. Due to the relative flexibility of the cylindrically shaped packages in the horizontal direction, the side surfaces of the reactor tend to vibrate in response to the forces, thereby creating audible sound.

Air core reactors are often located in populous areas, and the sound created by the reactors can be a serious irritant to the local population. It is known to locate air core reactors behind walls to isolate them, or to construct a separate sound shield around each reactor to surround it with sound absorbing material. The cost of such structures is high, and they may inhibit physical access to the reactor for maintenance activities.

BRIEF DESCRIPTION OF THE DRAWINGS

The invention is explained in the following description in view of the drawings that show.

DETAILED DESCRIPTION OF THE INVENTION

While traditional solutions to mitigating the adverse effects of audible sound created by an air core reactor have focused on isolating the reactor from neighboring populations, the present inventors have innovatively looked to the source of the sound itself in order to reduce the amount of sound energy produced by the operation of the reactor. The inventors have recognized that prior art air core reactors have been designed on the basis of their electrical performance, but they are not optimized for their acoustic performance. The inventors have developed improvements in the design of such reactors in order to accomplish a reduction in the sound levels emanating from the device during power operation, thereby reducing or eliminating the need for supplemental sound barriers.

Figure 2:
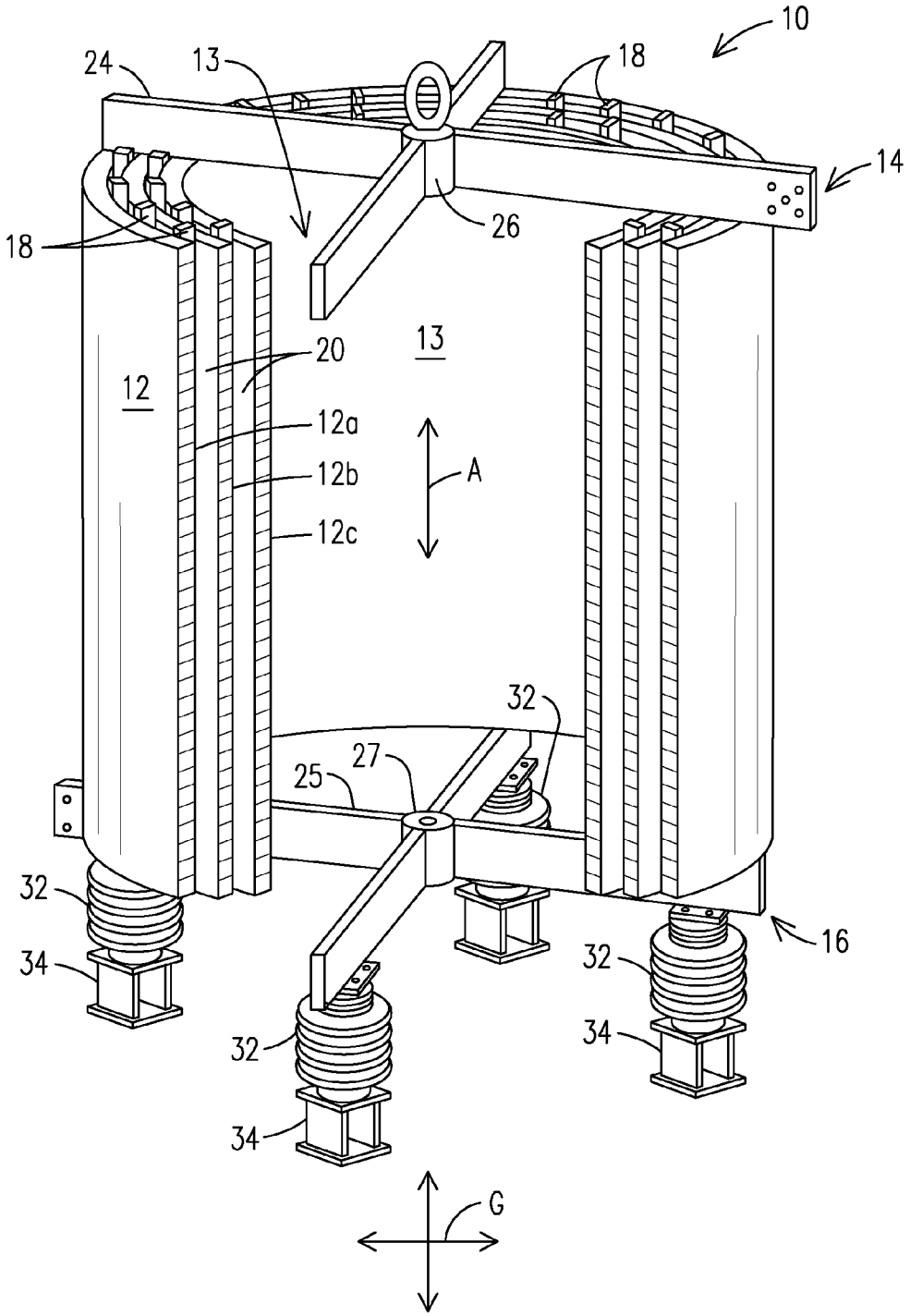
FIG. 2 PRIOR ART
FIG. 2 is a partial cut-away view of a prior art air core reactor.

FIG. 2 is a partial cut-away view of a prior art air core reactor 10 illustrating components typical of air core reactors. The reactor 10 includes a series of cylindrically shaped, spaced-apart packages 12 concentrically positioned about a central hub axis of symmetry A. The packages 12 typically have a thickness range, as measured in the radial direction, on the order of 0.5 to 3 cm and may vary in thickness. The cylindrical shape and relative thin cross section of the packages renders them susceptible to vibration and sound production caused by forces exerted on the packages in the radial direction. Although various reactor designs may include fewer or substantially more packages than shown in FIG. 2 (e.g., ranging from fewer than three packages to twenty or more packages), for simplicity of illustration, FIG. 2 illustrates only three such packages. The reactor 10 includes an innermost package 12*a*, an intermediate package 12*b* and an outermost package 12*c*. The reactor 10 is shown in a common orientation, positioned above a horizontal ground plane, G, with the hub axis A extending vertically above the ground plane. The reactor 10 includes a hollow reactor cavity 13 extending radially inward from the innermost package 12*a* toward the axis A. The cavity 13 and packages 12 are positioned between an upper spider unit 14 and a lower spider unit 16. The spider units have horizontal orientations with respect to the underlying ground plane G.

The packages 12*a*, 12*b*, 12*c* are separated from one another by a plurality of spacers 18 which are shown to have a vertical orientation extending in a direction parallel to the axis A. The spacers 18 are circumferentially spaced apart about the axis A to provide air gaps 20 between adjacent pairs of the packages 12*a*, 12*b*, 12*c*. In other embodiments (not illustrated), the reactor may include an outer sheathing or a rigid support structure to which an electrostatic shield may be attached.

(See United States Patent Application Publication 2011/0043320 A1 which is incorporated herein by reference.) For such embodiments, further spacers may be provided to facilitate separation of the sheathing or the rigid support structure from the outermost package to also provide an air gap there between. Each air gap 20 permits a current of air to flow upward along a surface of the respective package.

The spider units 14, 16 each include a series of arms 24, 25 radiating along a plane and away from the axis A in a star configuration. The upper and lower spider units 14, 16 illustrated each have four spider arms 24, 25, although the number of arms in the spider units may range from fewer than four to more than twelve. Among other functions, the spider arms 24, 25 serve as line terminals (not illustrated) for effecting power connections to and between the packages 12 in an electrically parallel configuration. The spider arms 24, 25 extend outward from a central hub 26, 27. Each package 12 may include a plurality of layers of spirally wound electrical conductors (not illustrated), with each conductor connected between an arm 24 of the upper spider 14 and an arm 25 of the lower spider 16. For a single reactor, or for at least the lower-most reactor 10 when arranged in a stacked configuration of reactors, the packages 12 are supported above the ground by a combination of spider arms 25 of the lower unit 16 and a series of structural leg members 34. In the illustrated embodiment, all four of the arms 24 of the lower spider unit 16 are supported directly by leg members 34 which each extend from a spider arm 24 to the ground. The leg members 34 of the reactor 10 each include an electrical insulator 32. The number of structural leg members supporting the reactor 10 can vary from fewer than four to more than twelve.

Prior art air core reactors are designed to minimize electrical losses while staying within component manufacturing cost constraints, which in turn minimizes the amount of heat generated and the expense of operation of the device. For example, prior art reactors are configured such that the current passing through each package and each winding of each package is generally in-phase (i.e. ±10 degrees) with the current in other packages and windings at the grid power frequency. The inventors have discovered that such designs can be improved to reduce the amount of audible sound produced by the device while still satisfying overall design specification requirements for the device, including having an acceptable level of loss. Sound is produced by force acting on structures of the reactor resulting in those structures deflecting and creating sound waves in the surrounding air. The inventors have reduced sound by designing a change in a phase relationship of the force generated in at least one winding or package when compared to the phase of the force generated in other windings or packages. In embodiments of the invention, a current in at least one package is greater than 10 degrees out of phase with a current in other packages, or at least 20 degrees out of phase, or at least 45 degrees out of phase, or at least 90 degrees out of phase, or up to 180 degrees out of phase at the power frequency (typically 60 Hz or 50 Hz depending upon the country of use) or at all frequencies of 1 kHz or less. Note that audible sound issues are generally not of concern at current, frequencies higher than 1 kHz. By changing the current phase angles, the phase angles of resulting forces are changed accordingly such that the forces generated in the one package are a corresponding number of degrees out of phase with the forces in the other packages. The result is lower net forces acting on potential significant sound radiating surfaces and lower vibration and sound levels.

Figure 1:
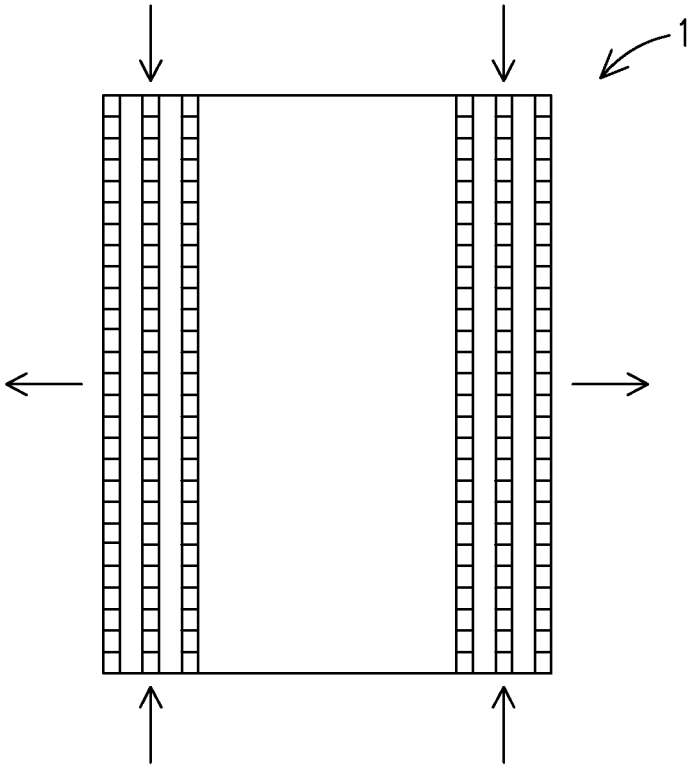
FIG. 1 PRIOR ART
FIG. 1 is a schematic illustration of the forces generated during operation of an air core reactor which result in the generation of audible sound.
Figure 3:
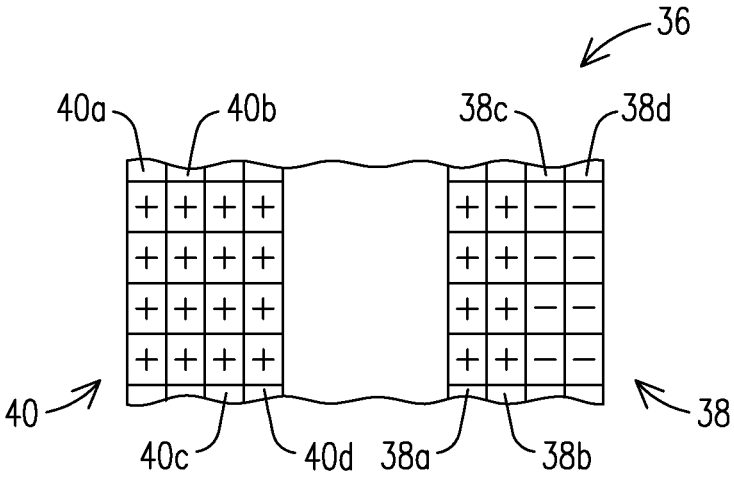
FIG. 3 is a partial sectional view of an air core reactor wherein current in some windings is purposefully configured to reduce overall sound level.

The out of phase current may be carried by all conductive winding layers in a particular package, or by only some of the conductive winding layers in a package. FIG. 3 is a partial cross-sectional illustration of an exemplary air core reactor 36 showing portions of two packages 38, 40 each having four conductor winding layers 38*a*, 38*b*, 38*c*, 38*d* and 40*a*, 40*b*, 40*c*, 40*c*. In this example, the reactor 36 is configured such that two outermost winding layers 38*c*, 38*d* of one package 38 conduct current that is out of phase with the current conducted in the two innermost winding layers 38*a*, 38*b* of that same package 38, as well as being out of phase with the current conducted in the adjacent package 40. In this embodiment, the out of phase current is indicated as being opposite (180 degrees out of phase, marked as + and −), but is at least 10, 20, 45, 90 or 180 degrees out of phase at the power frequency or at all frequencies of 1 kHz or less in accordance with other embodiments of the invention. Further embodiments may conduct the out of phase current in at least one to as many as all of the winding layers of a package, or in more than one package. Such designs can be achieved using known design tools and techniques commonly available to one skilled in the art of air core reactor design.

It may be appreciated that the magnitude of the current carried by each conductor winding of a reactor is a design variable controlled by the designer. As such, it may be desired that the conductor winding carrying the out of phase current carry a lower current magnitude than other conductors in order to limit stresses imposed on the structure and to control losses during power operation. Thus, it will also be appreciated that the present invention has introduced sound production as a design element that can be balanced against other known design requirements, such as electrical losses, manufacturing and material cost, heat generation and dissipation, dimensions, mechanical stresses, etc. Moreover, in consideration of the mechanical response of the structure and the varying sensitivity of human ears over the frequency spectrum, embodiments of the invention may selectively mitigate sound production in particular frequency ranges, perhaps even at the cost of increasing sound production in other frequency ranges.

The desired out of phase current/force may be accomplished by changing a direction of a spiral in the conductor windings to be opposite (e.g. counter clockwise) from a direction of a spiral of the other conductor windings (e.g. clockwise) in an embodiment. It may be particularly advantageous for the out of phase current to occur in the outermost and/or innermost package. In one embodiment, at least one conductor winding carries no current.

Figure 4:
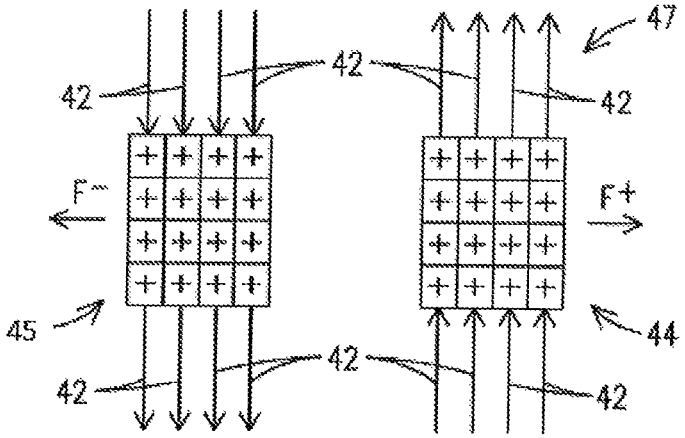
FIG. 4 is a partial sectional view of an air core reactor wherein a force generated in one package is out of phase with a force generated in another package.

The magnetic field generated during operation of an air core reactor is a function of the current distribution within the reactor. The inventors have realized that it is possible to control the current distribution to advantageously shape the magnetic field such that it flows in one direction through the bulk of the reactor but in an opposite direction through the outermost package(s). In this manner, a sound generating force is produced in the outermost package that is out of phase with the sound generating force produced in the bulk of the reactor by currents that are flowing in the same direction through all of the packages. When the force induced in one winding or package is out of phase (including being in an opposite direction) to that induced in another winding or package, a sound canceling effect is achieved. This concept is illustrated in FIG. 4 where lines of total coil magnetic flux 42 are shown turning in space and passing in opposite directions through an outmost package 44 and a more inward package 45 of an air core reactor 47. The current direction in all windings of this embodiment is in the same direction (+), but because the magnetic field is reversed between the packages, the resulting driving force is in opposite ($F^+$, $F^-$) directions.

Accordingly, in embodiments of the invention, an air core reactor may be configured such that an interaction of a current in an outermost package with a magnetic field generated by the reactor during power operation generates a force that is at least 10, 20, 45, 90 or 180 degrees out of phase with a force generated in a more inward package at the power frequency or at all frequencies of 1 kHz or less, effective to at least partially mitigate sound produced by power operation of the reactor.

Figure 5:
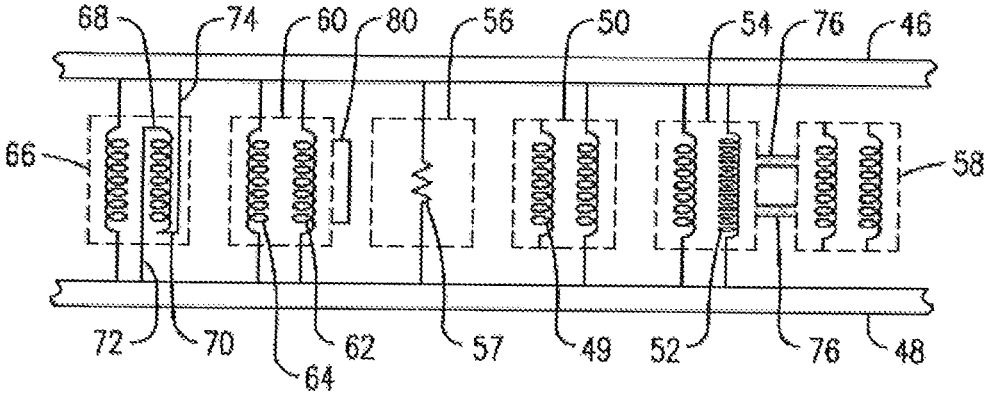
FIG. 5 is a schematic winding design illustrating the interconnection of various packages of an air core reactor.

FIG. 5 is a schematic illustration of design features within a package and/or between packages that may be used to generate an out of phase current or force in a winding or package. Such design features include but are not necessarily limited to:

disconnect one or more conductor windings (layers) 49 of a package 50 from at least one of the spiders 46, 48;

increase the number of turns in one 52 or more conductor windings of one 54 or more packages compared to the other packages;

include one 56 or more packages or one or more conductor windings tuned to a relatively lower current than in other packages/windings. This may be accomplished, for example, by constructing the conductor winding(s) to have more turns, or to be formed from a smaller gauge wire (represented in FIG. 5 by resistor 57);

change the conductor material in one or more packages, such as using copper conductor material in the outermost package 58 and aluminum conductor material in the other packages;

include one or more dummy packages (i.e. not connected electrically) including an outmost dummy package 58;

construct the spiral shape of the conductor in one or more layers of one 60 or more packages in the opposite direction (i.e. clockwise 62 verses counterclockwise 64 relative to the hub axis);

direct the current through the conductor in one or more layers of one 66 or more packages in the opposite direction relative to the top 46 and bottom 48 spiders. This is illustrated schematically by connecting the top of the conductor 68 of a package 66 to a bottom spider 48 and the bottom 70 of that conductor to the top spider 46 using jumper connectors 72, 74.

Advantageously, some of the modifications discussed above also function to increase the mass or stiffness of at least some of the packages, for example the innermost and/or outermost packages. For any given driving force, a higher mass and/or a higher stiffness will result in a lower total displacement of the packages. Since the sound energy of concern is generated by the radial movement of the sides of the packages, particularly the innermost and outermost packages, any modification that increases the mass or the stiffness of a package will affect the level of sound produced. An increase in mass will generally lower the natural frequency of the package, while an increase in stiffness will generally raise the natural frequency of the package. Thus, these variables can be used by the designer to tailor the mechanical response of the reactor and to thereby affect its sound production.

As illustrated in FIG. 5, a package 58 may be closely coupled mechanically to the adjacent package 54 with any known mechanical joining device 76 (clamp, frame, bolt, adhesive, etc.) such that it reduces the extent of excursion of the outer surface of the packages and thus decreases the amount, of sound produced. The inventors have also reduced the sound by the selective addition of non-conductive material to at least one package in order to change the deflection of the package in response to the net driving force. The material may simply increase the weight and thereby lower its natural frequency, such as by simply adding layers of epoxy to make the package thicker. Alternatively, the material may be configured to increase the stiffness of the package, such as by forming the material in the shape of a rib 80 attached to an outer surface of the package.

While various embodiments of the present invention have been shown and described herein, it will be apparent that such embodiments are provided by way of example only. Numerous other variations, changes and substitutions may be made without departing from the invention concepts disclosed herein. Accordingly, it is intended that the invention be limited only by the spirit and scope of the claims which now follow.

The claimed invention is:

1. An air core reactor comprising:

a plurality of concentric packages of conductor windings electrically interconnecting upper and lower spiders;

at least one of the packages being configured to conduct a current that is at least 10 degrees out of phase and not 180 degrees out of phase at a power frequency with a current conducted by another package of the reactor during power operation, thereby generating a sound mitigating force within the reactor; and wherein one conductor winding of the at least one package carries the out of phase current, and another conductor winding of the at least one package carries a current that is in phase with the current conducted by a winding in the another package.

2. The air core reactor of claim 1, wherein the current conducted by the at least one package is at least 20 degrees out of phase and not 180 degrees out of phase.

3. The air core reactor of claim 1, wherein the current conducted by the at least one package is at least 45 degrees out of phase and not 180 degrees out of phase.

4. The air core reactor of claim 1, wherein the current conducted by the at least one package is at least 20 degrees out of phase and not 180 degrees out of phase at all frequencies up to 1 kHz.

5. The air core reactor of claim 1, wherein the current conducted by the at least one package is at least 45 degrees out of phase and not 180 degrees out of phase at all frequencies up to 1 kHz.

6. The air core reactor of claim 1, wherein the current conducted by the at least one package is at least 90 degrees out of phase and not 180 degrees out of phase at all frequencies up to 1 kHz.

7. The air core reactor of claim 1, wherein a conductor winding carrying the out of phase current carries a lower current magnitude than a conductor winding of the another package.

8. The air core reactor of claim 1, wherein at least one conductor winding of the at least one package carries no current.

9. The air core reactor of claim 1, wherein the at least one package is an outermost or an innermost package.

10. The air core reactor of claim 1, wherein a direction of a spiral in at least one conductor winding in the at least one package is opposite to a direction of a spiral of a conductor winding in the another package.

11. The air core reactor of claim 1, further comprising an electrically non-conductive material affixed to the another package.

12. The air core reactor of claim 11, wherein the material is configured to increase a stiffness of the another package.

13. The air core reactor of claim 1, further comprising a material of construction of conductive windings in a first package being different than a material of construction of conductive windings in a second package.

14. An air core reactor comprising:

a plurality of concentric packages of conductor windings electrically interconnecting upper and lower spiders;

wherein the packages are configured such that an interaction of a current in an outermost package with a magnetic field generated by the reactor during power operation generates a force that is at least 10 degrees out of phase and not 180 degrees out of phase at a power frequency with a force generated in a more inward package, effective to at least partially mitigate sound produced by power operation of the reactor; and wherein one conductor winding of the at least one package carries the out of phase current, and another conductor winding of the at least one package carries a current that is in phase with the current conducted by a winding in the another package.

15. The air core reactor of claim 14, further configured such that a first conductor winding of the outermost package carries a current that is at least 10 degrees out of phase at the power frequency from a current carried in a second conductor winding of the outermost package.

16. The air core reactor of claim 15, configured such that the currents carried in the first and second conductor windings flow in opposite directions.

17. The air core reactor of claim 14, further configured such that a conductor winding of the outermost package carries a current that is at least 10 degrees out of phase at the power frequency from a current carried in a conductor winding of a more inward package.

18. The air core reactor of claim 14, further comprising a material of construction of conductive windings in the outermost package being different than a material of construction of conductive windings in a more inward package.

* * * * *